US010065716B2

(12) United States Patent
Sylvia et al.

(10) Patent No.: US 10,065,716 B2
(45) Date of Patent: Sep. 4, 2018

(54) AUTONOMOUS UNDERWATER VEHICLE WITH EXTERNAL, DEPLOYABLE PAYLOAD

(71) Applicant: LOCKHEED MARTIN CORPORATION, Bethesda, MD (US)

(72) Inventors: Russell M. Sylvia, Bethesda, MD (US); Robert P. Gordon, Jr., Bethesda, MD (US); Martin C. Lewis, Bethesda, MD (US)

(73) Assignee: Lockheed Martin Corporation, Bethesda, MD (US)

( * ) Notice: Subject to any disclaimer, the term of this patent is extended or adjusted under 35 U.S.C. 154(b) by 0 days.

(21) Appl. No.: 15/619,668

(22) Filed: Jun. 12, 2017

(65) Prior Publication Data

US 2017/0274970 A1 Sep. 28, 2017

Related U.S. Application Data

(63) Continuation of application No. 14/627,743, filed on Feb. 20, 2015, now Pat. No. 9,701,378.

(60) Provisional application No. 61/942,890, filed on Feb. 21, 2014.

(51) Int. Cl.

| | |
|---|---|
| ***B63G 8/08*** | (2006.01) |
| ***B63G 8/00*** | (2006.01) |
| ***B63G 8/22*** | (2006.01) |

(52) U.S. Cl.

CPC ..... *B63G 8/001* (2013.01); *B63G 8/08* (2013.01); *B63G 8/22* (2013.01); *B63G 2008/004* (2013.01)

(58) Field of Classification Search

CPC ..... B63G 8/22; B63G 2008/004; B63G 8/001

See application file for complete search history.

(56) References Cited

U.S. PATENT DOCUMENTS

| | | | |
|---|---|---|---|
| 3,171,376 | A | 3/1965 | Sellner et al. |
| 3,335,684 | A | 8/1967 | Trippel |
| 3,404,649 | A | 10/1968 | Valihora |
| 3,683,835 | A | 8/1972 | Deslierres |
| 6,854,410 | B1 | 2/2005 | King et al. |
| 7,013,827 | B2 | 3/2006 | Todd et al. |
| 7,721,669 | B1 | 5/2010 | Portmann et al. |

(Continued)

FOREIGN PATENT DOCUMENTS

| | | |
|---|---|---|
| CN | 1666925 | 9/2005 |

OTHER PUBLICATIONS

International search report for international application No. PCT/US2015/016870, dated Jun. 1, 2015 (3 pages).

(Continued)

*Primary Examiner* — Anthony D Wiest

(74) *Attorney, Agent, or Firm* — Hamre, Schumann, Mueller & Larson, P.C.

(57) ABSTRACT

An AUV is described that includes an external, deployable payload releasably attached to the exterior of the AUV. The release mechanism between the payload and the AUV is relatively simple and low cost. The payload is mounted external to the AUVs hull and does not significantly increase the cost of the AUV to which it is attached. There are no complex release mechanisms or intermediate launch systems attached to the AUV. Therefore, the described AUV can deploy payloads, such as sensors, that would normally be deployed from a manned platform. This can increase the payload capability of a small expendable AUV without increasing volume or cost of the AUV.

9 Claims, 8 Drawing Sheets

(56) References Cited

U.S. PATENT DOCUMENTS

| | | | |
|---|---|---|---|
| 8,167,670 | B1 | 5/2012 | Gibson et al. |
| 8,205,570 | B1 | 6/2012 | Tureaud et al. |
| 8,408,956 | B1 | 4/2013 | Vosburgh |
| 2008/0127877 | A1 | 6/2008 | Ansay et al. |
| 2013/0206049 | A1 | 8/2013 | Spickermann et al. |

OTHER PUBLICATIONS

Written Opinion for international application No. PCT/US2015/016870, dated Jun. 1, 2015 (7 pages).
Extended European search report for European patent application No. 15752203.8, dated Sep. 21, 2017 (9 pages).

AUTONOMOUS UNDERWATER VEHICLE WITH EXTERNAL, DEPLOYABLE PAYLOAD

FIELD

This disclosure relates to carrying and deploying diverse payloads from an underwater vehicle such as an autonomous underwater vehicle (AUV).

BACKGROUND

AUVs have become a cost-effective alternative to deep sea manned and unmanned tethered technologies. The demand for AUVs carrying diverse payloads has increased the costs of AUVs. A trend has been to develop larger AUVs capable of carrying diverse payloads which increase the size and cost of the AUV proportionally.

In addition, releasing payloads from an AUV underwater is a difficult and expensive task. Releasing or deploying payloads from AUVs underwater has generally been done by stowing the payload inside the AUV's hull. A port in the side of the hull opens and communicates to the ocean and releases the payload. Other AUV designs have launch tubes and or docking stations mounted to the exterior of the hull. The launch tubes and docking stations tend to be much smaller compared to the AUV and thus they have minimal impact on the buoyancy of the AUV. In addition, these are very complex and expensive solutions utilized in reusable AUV applications.

In addition, it is sometimes desirable to create a stand-off distance between the AUV and the payload once the payload is released.

SUMMARY

An AUV is described that includes an external, deployable unmanned payload releasably attached to the exterior of the AUV. The release mechanism between the payload and the AUV is relatively simple and low cost. The payload is mounted external to the AUVs hull and does not significantly increase the cost of the AUV to which it is attached. There are no complex release mechanisms or intermediate launch systems attached to the AUV. Therefore, the described AUV can deploy payloads, including but not limited to sensors, that would normally be deployed from a manned platform. This can increase the payload capability of a small expendable AUV without increasing volume or cost of the AUV. In one embodiment, the external payload is approximately the same size as the AUV so that the buoyancy of the AUV is changed.

The deployable unmanned payload has its own contained displaced volume, therefore it does not disturb the volume of the AUV. The payload is a structure that is separate from the AUV, and is not a part or sub-part of the AUV, so that the displaced volume of the AUV remains the same before and after release of the payload from the AUV. Once the payload is released, the AUV is capable of continuing on its mission, for example by traveling to a new location which helps to create a stand-off distance between the AUV and the released payload. In another embodiment, the payload can be deployed and towed like a tethered body from the AUV. In still another embodiment, a standoff distance can be created between the manned or unmanned platform, whether aerial, surface or sub-surface, that the AUV is launched from.

In one embodiment, releasing the external payload is achieved with a burn wire mechanism that contributes to securing the external payload to the AUV. The burn wire mechanism includes a burn wire that is programmed to burn at a predetermined time during the mission. At the appropriate time, electricity is sent through the burn wire, and the burn wire heats up and breaks. When the burn wire breaks, the external payload(s) is released and the AUV reverts back to its original intended state to continue its mission. Other forms of release mechanisms can be used as well.

The embodiments described herein create a method to use an expendable AUV that is designed for a single mission to carry diverse payloads to extend the capability of the AUV for many different missions. However, the AUV does not need to be expendable. Rather, the AUV can be re-used after it releases the payload.

The payload can also be expendable or the payload can be re-useable.

In addition, in another embodiment, the AUV can carry multiple external payloads, with the payloads being the same as or different from one another, and with each payload being separately or jointly releasable from the AUV.

As used herein, an AUV can be any unmanned underwater vehicle designed to operate underwater. The term "unmanned" means the AUV (and the payload) does not physically carry a human operator. In some embodiments, the AUV can be completely autonomous so that its operation is preprogrammed with no remote human control or operational intervention. In another embodiment, the AUV can be semi-autonomous so that some or all of its operation is controlled remotely by one or more human operators.

In one embodiment, the external payload is attached to the outside of the AUV in a vertically stacked or a horizontal side-by-side configuration. In other embodiments, the external payload can be attached to the front or rear of the AUV in a generally collinear arrangement.

The payload can be a generally cylindrical body to maximize hydrodynamic efficiency. However, other payload shapes can be used as well.

In one embodiment, the payload can be in the form of optional external ballast, including but not limited to ballast weights, that can be used as needed, for example to adjust the weight distribution of the AUV-payload combination. The ballast payload can be separate from both the AUV and other payload(s) and can be released when the other payload (s) is released, or released separately from the AUV.

The payload may be a completely autonomous system separate from the AUV, or the payload can communicate by suitable communication technology including but not limited to, wirelessly, using a tether line or other communication technology, with the AUV to transfer data and power.

In one embodiment, a combination comprises an autonomous underwater vehicle with an exterior surface and a displaced volume, and an external payload is releasably deployable from the autonomous underwater vehicle. The external payload is releasably connected to the exterior surface of the autonomous underwater vehicle by a releasable mechanism, and the displaced volume of the autonomous underwater vehicle remains the same before and after release of the external payload. While the combination is submerged under water, the external payload can be deployed from the autonomous underwater vehicle by releasing the releasable mechanism.

In another embodiment, a method of deploying a payload in water comprises releasably mounting a payload to an exterior of an autonomous underwater vehicle having a displaced volume. The autonomous underwater vehicle with the payload mounted thereto into water is launched into the water. While the autonomous underwater vehicle and the payload are submerged under the water, the payload is released from the autonomous underwater vehicle so that the displaced volume of the autonomous underwater vehicle remains the same after release of the payload.

DRAWINGS

FIGS. 7A-D illustrates an example sequence of operation of the AUV and release of the expendable ballast tank therefrom.

Figure 8A:
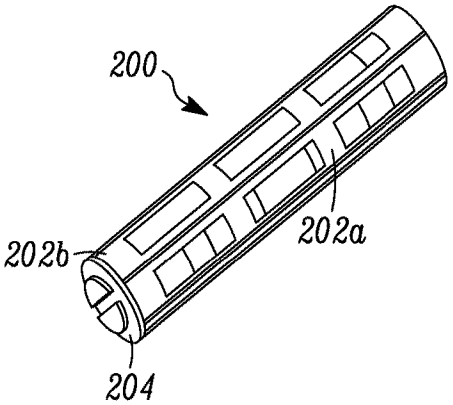
Figure 8B:
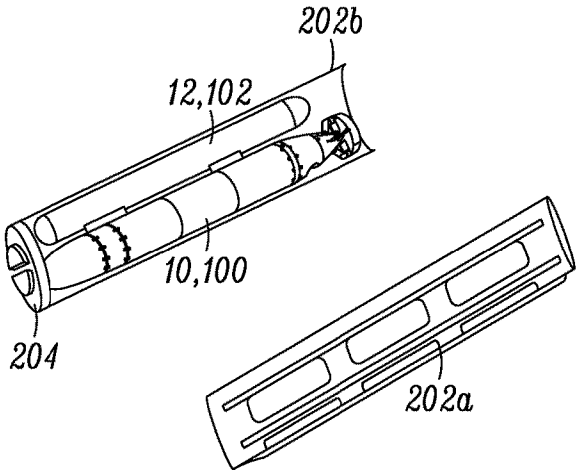
Figure 8C:
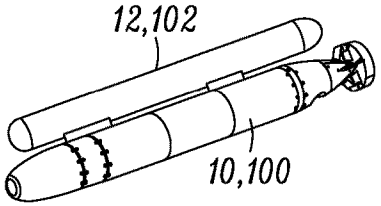

FIGS. 8A-C illustrate an example of a launch kit that can be used to launch the AUV and the external payload attached thereto from a launch platform such as a submarine.

DETAILED DESCRIPTION

Figure 1:
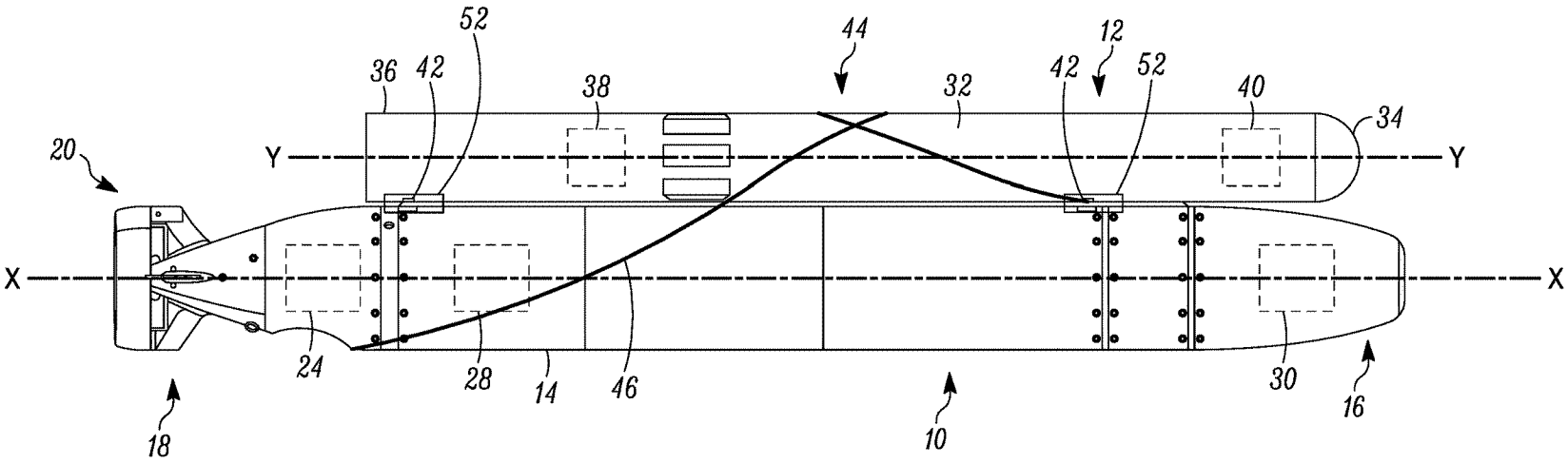
FIG. 1 is a side view of an AUV carrying an external, deployable payload.

FIG. 1 shows a side view of an AUV 10 carrying an external, deployable unmanned payload 12. The AUV 10 is of generally conventional construction known in the art including a cylindrical hull 14, a hydro-dynamically shaped, for example bullet shaped, forward end 16, and an aft end 18 containing a propulsion mechanism 20, such as a propeller 22 (best seen in FIG. 2) driven by a motor 24 (shown in dashed lines in FIG. 1), for propelling the AUV 10 through the water. The AUV 10 can also include a steering mechanism, separate from or integral with the propulsion mechanism, for example steerable fins 26 (best seen in FIG. 2) or the propulsion mechanism 20 can be steerable to function as the steering mechanism.

The AUV 10 can also include a suitable power supply 28 (shown in dashed lines in FIG. 1), for example one or more batteries, disposed within the hull 14 for providing power to the AUV 10 and optionally provide power to the payload 12. Suitable control electronics for controlling operation of the AUV 10 can also be disposed within the hull 14.

The AUV 10 can also carry one or more mission specific packages 30 (shown in dashed lines in FIG. 1) suitable for its intended mission. Examples of mission specific packages include, but are not limited to, various sensor packages, sonar packages, munitions packages, communications packages, and the like.

With reference to FIG. 1, the payload 12 is illustrated as being releasably mounted on the AUV 10 in a vertically stacked configuration. However, the payload 12 and the AUV 10 can be arranged in a horizontal side-by-side configuration as well, or in any other configuration where the payload 12 is mounted external to the hull 14 of the AUV 10. Using a vertically stacked arrangement is easier to implement since the disruption to the hydrodynamics of the AUV 10 are easier to compensate for. In some embodiments, the payload 12 can be mounted to the forward end 16 or to the aft end 18 of the AUV 10 in a generally collinear arrangement.

As shown in FIG. 1, the AUV 10 includes a first longitudinal axis X-X, and the payload 12 includes a second longitudinal axis Y-Y. In the vertically stacked configuration illustrated in FIG. 1, as well as in a horizontal side-by-side configuration, the axes X-X and Y-Y are parallel to one another but offset from each other. In another embodiment where the payload 12 and the AUV 10 are in a generally collinear arrangement, the axis X-X will be generally parallel to and generally collinear with the axis Y-Y.

To be more hydro-dynamically efficient, the payload 12 is illustrated in FIG. 1 as having a cylindrical configuration with a generally cylindrical hull 32 having a hydro-dynamically shaped, such as bullet shaped, forward end 34 and an aft end 36. In the illustrated embodiment, the payload 12 does not have a separate propulsion mechanism or steering capability. Therefore, when the payload 12 is released from the AUV 10, the payload 12 is intended to float submerged under the water, float at the surface of the water, and/or sink to the bottom, depending upon the buoyancy characteristics of the payload 12 and its intended mission.

In some embodiments, the buoyancy characteristics of the payload 12 can be controlled so that the payload can selectively achieve multiple positions in the water during its mission. For example, the buoyancy of the payload 12 can be controlled so that the payload is initially floating submerged in the water, then the buoyancy is changed so that the payload 12 floats at or near the surface of the water, and then the buoyancy is changed again so that the payload sinks to the bottom. Other multiple position schemes can be achieved by changing the buoyancy of the payload 12.

The payload 12 can carry its own internal power supply 38 (illustrated in dashed lines in FIG. 1), such as one or more batteries, which provide power to the payload 12. In one embodiment, the payload power supply 38 can supply all of the power the payload 12 requires while it is attached to the AUV 10. In another embodiment, the payload power supply 38 can supply some power to the payload 12 while the power supply 28 of the AUV 10 supplies some power to the payload 12 while the two are attached. In still another embodiment, the AUV power supply 28 can supply all power to the payload 12 while the two are attached to avoid draining the payload power supply 38.

Once the payload 12 separates from the AUV 10, the payload power supply 38 can supply all of the power the payload 12 requires. In another embodiment, power can be supplied to the payload 12 via a tether (not shown) that connects the AUV 10 and the payload 12 even after the payload 12 separates from the AUV 10.

Likewise, while attached, the payload 12 may communicate using a suitable communication technique, for example wirelessly or using a tether line, with the AUV 10 to transfer data to and from the AUV 10. In addition, after separation, the payload 12 may communicate using a suitable communication technique, for example wirelessly or using a tether line, with the AUV 10 to transfer data to and from the AUV 10.

The payload 12 can carry one or more mission specific packages 40 suitable for its intended mission. Examples of mission specific packages 40 include, but are not limited to, various sensor packages, sonar packages, munitions packages, communications packages for transmitting and/or receiving signals, and the like. The payload 12 can also have data processing capability provided by one or more data processors. In one embodiment, the payload 12 is a sensor payload that contains one or more sensor packages designed to perform a sensing mission at its deployed location. In another embodiment, the payload can be a payload launch system that launches a specific payload.

In one embodiment, the payload 12 can include control surfaces including, but not limited to, controllable steering fins, or other steering capability. It is preferred that the payload not include its own propulsion mechanism, although in some embodiments the payload 12 can include a propulsion mechanism.

The payload 12 is a structure that is separate from the AUV 10, and is not a part or sub-part of the AUV 10. As a result, the displaced volume of the AUV 10 remains the same before and after release of the payload 12 from the AUV 10.

Figure 3:
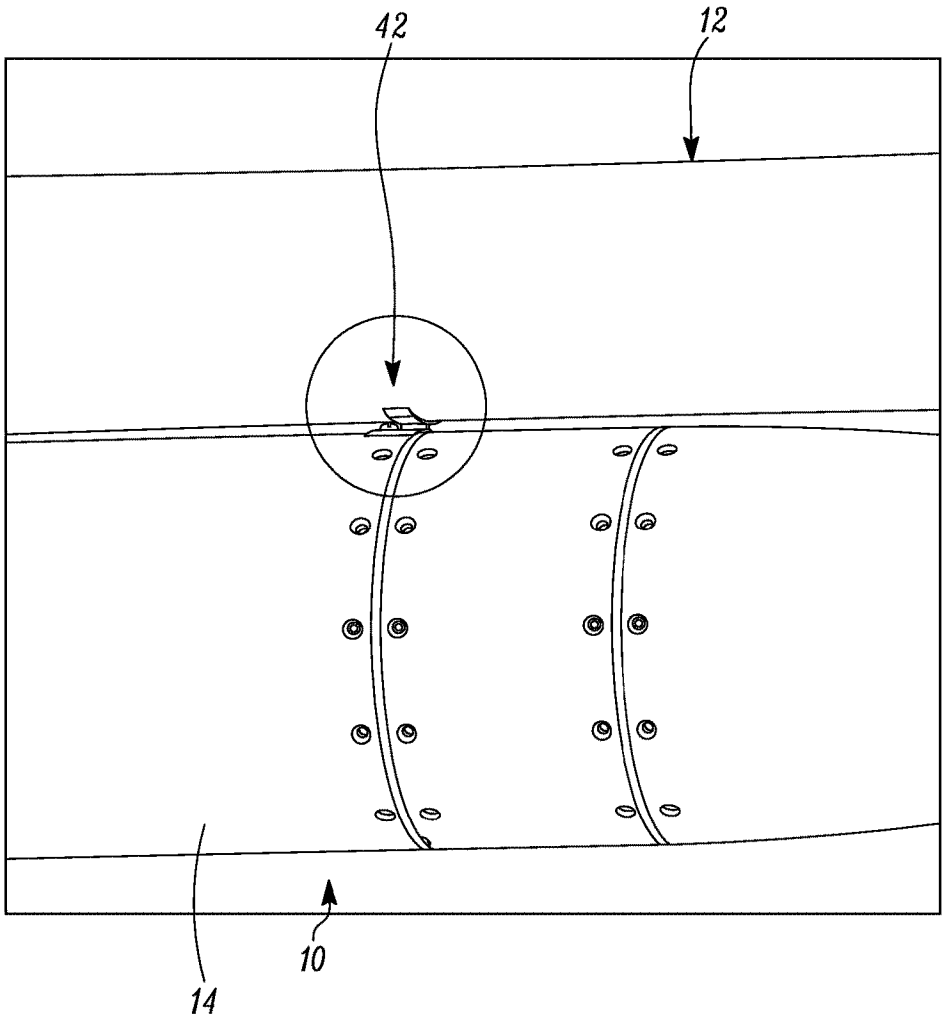
FIG. 3 is a close-up view of a portion of the payload support on the AUV.

Referring to FIGS. 1 and 3, one or more payload supports 42 are fastened to the AUV 10, for example on the exterior surface of the hull 14. In the illustrated example, there are two payload supports 42, one support 42 supporting a forward end of the payload 12, and one support 42 supporting a rear end of the payload 12. The payload supports 42 passively support the payload 12 on the AUV 10 without fastening the payload 12 to the AUV 10 so that, absent other means for securing the payload 12 to the AUV 10, the payload 12 can freely separate from the payload supports 42. In the illustrated example, each payload support 42 comprises a curved support bracket that generally matches the curvature of the cylindrical hull 32 of the payload 12 so that the payload 12 rests on the curved brackets when the payload 12 is attached to the AUV 10. However, other payload support configurations can be used.

Figure 2:
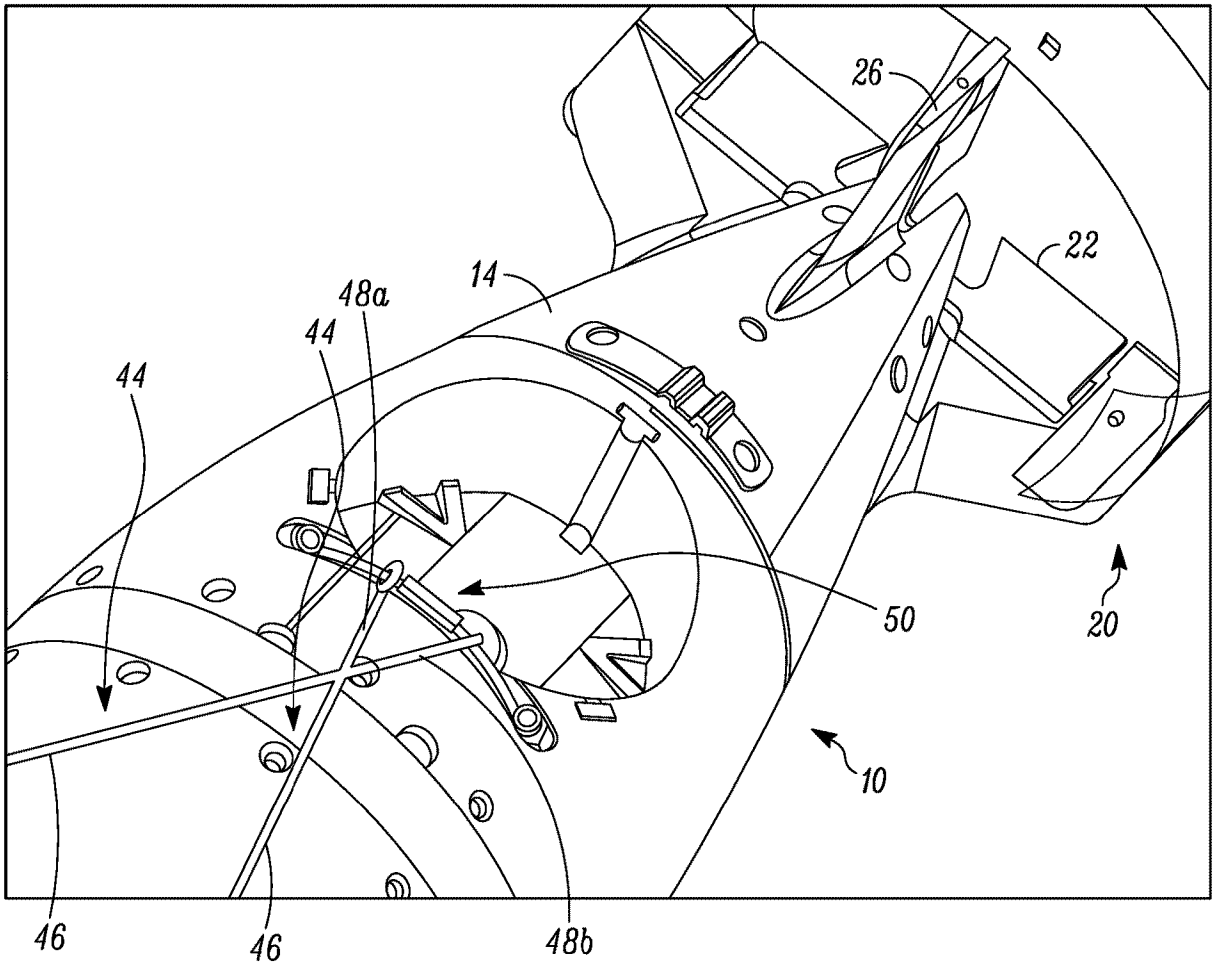
FIG. 2 is a detailed view of a portion of the AUV showing one form of releasable connection between the AUV and the external payload.

Referring to FIGS. 1 and 2, a releasable mechanism 44 releasably fastens the payload 12 on the AUV 10. Any releasable mechanism 44 that can retain the payload 12 on the AUV 10, and that can be actuated to release the payload 12 from the AUV 10, can be used.

In the illustrated embodiment, the releasable mechanism 44 comprises a one-piece wire 46 that crosses over the payload 12, around one of the payload supports 42, and attaches at its free ends 48*a*, 48*b* to a burn wire 50 as best seen in FIG. 2. The burn wire 50 is illustrated in FIG. 2 as being located on the outside of the hull 14 of the AUV 10. However, the burn wire 50 can be disposed inside the hull 14 as long as the ends 48*a*, 48*b* can be released to permit release of the payload 12. In addition, the burn wire 50 could be located on the payload 12 to initiate release via the payload 12 rather than via the AUV 10.

The one-piece wire 46 is sufficient to retain the payload 12 on the AUV 10 during typical anticipated use. To release the payload 12, electricity is sent through the burn wire 50 which causes the burn wire 50 to heat up and break. When the burn wire 50 breaks, the ends 48*a*, 48*b* of the wire 46 are released, which releases the external payload 12 and any external ballast 52 (if used). One advantage of using the external ballast 52 is that neither the AUV 10 nor the payload 12 needs to be modified for ballast. Also, the payload 12 could remain buoyant if needed and the ballast 52 can be jettisoned with the payload 12 from the AUV 10, leaving the AUV 10 and the payload 12 properly trimmed to continue with their respective missions.

After release of the payload 12, the AUV 10 can continue its mission and travel away from the released payload 12. Thus, a stand-off distance can be created between the AUV 10 and the released payload 12. In addition, a standoff distance is created between the manned or unmanned platform, whether aerial, surface or sub-surface, that the AUV 10 and payload 12 attached thereto are launched from.

Figure 4:
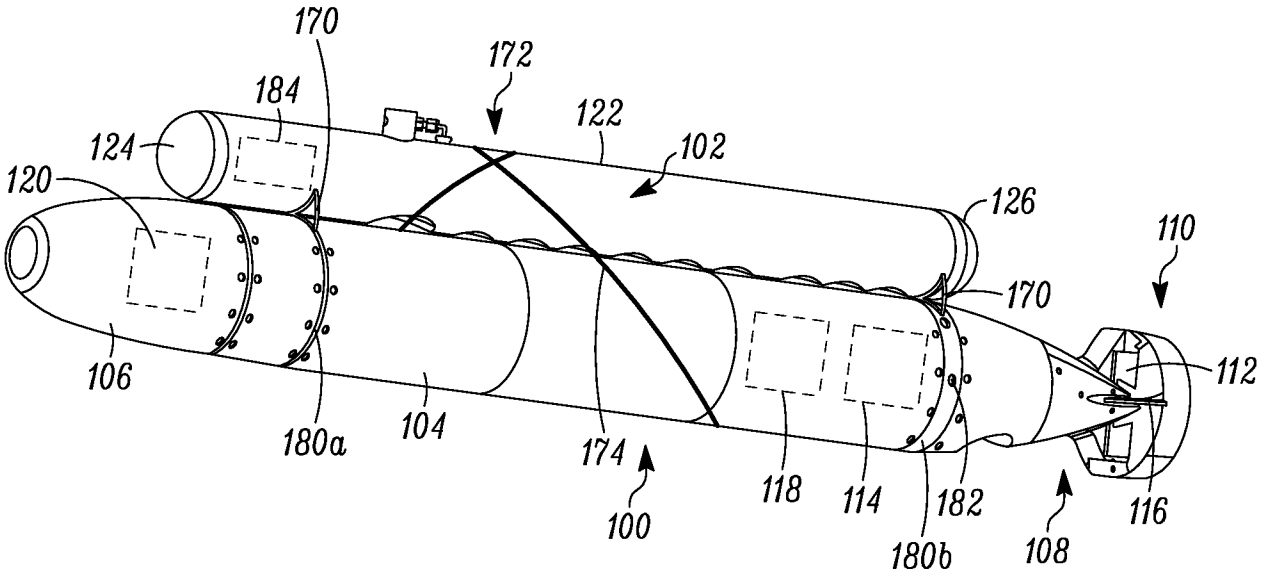
FIG. 4 is a perspective view of another embodiment of an AUV carrying an external, deployable payload in the form of an expendable ballast tank.
Figure 5:
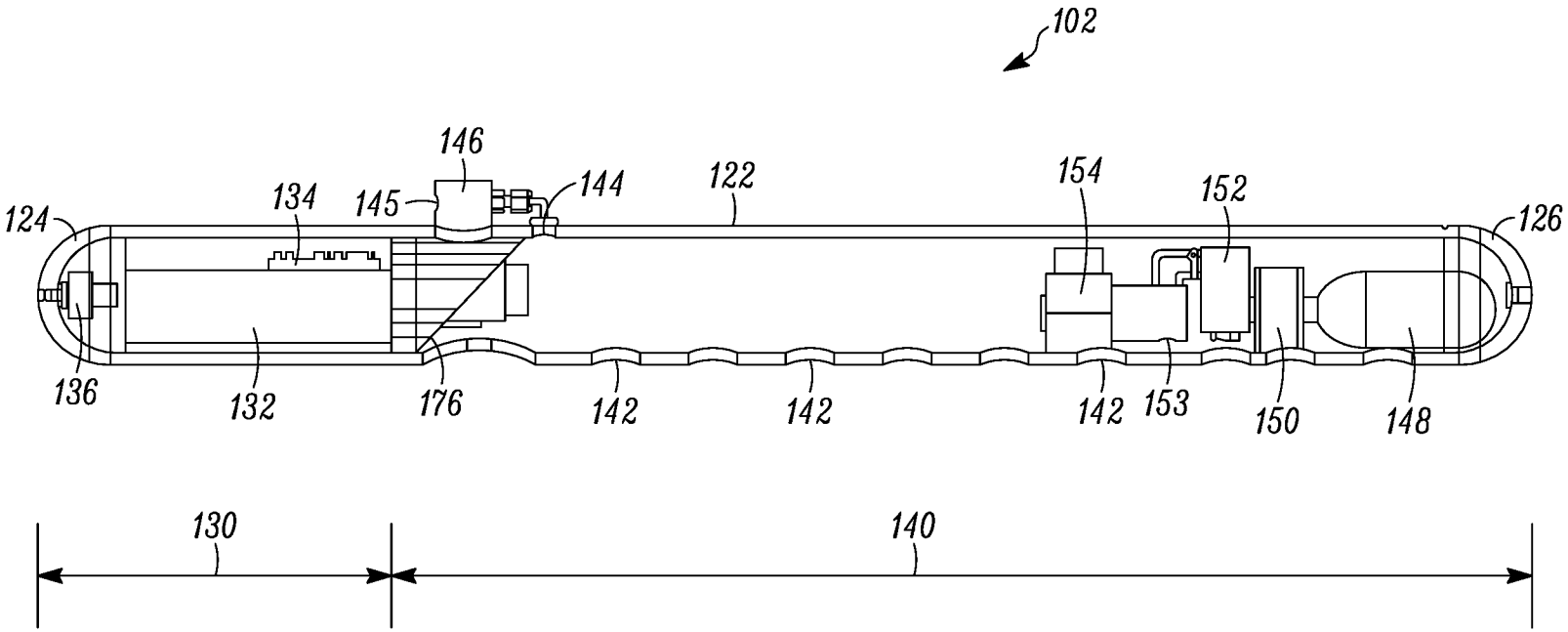
FIG. 5 is a cross-sectional side view of the expendable ballast tank of FIG. 4.
Figure 6:
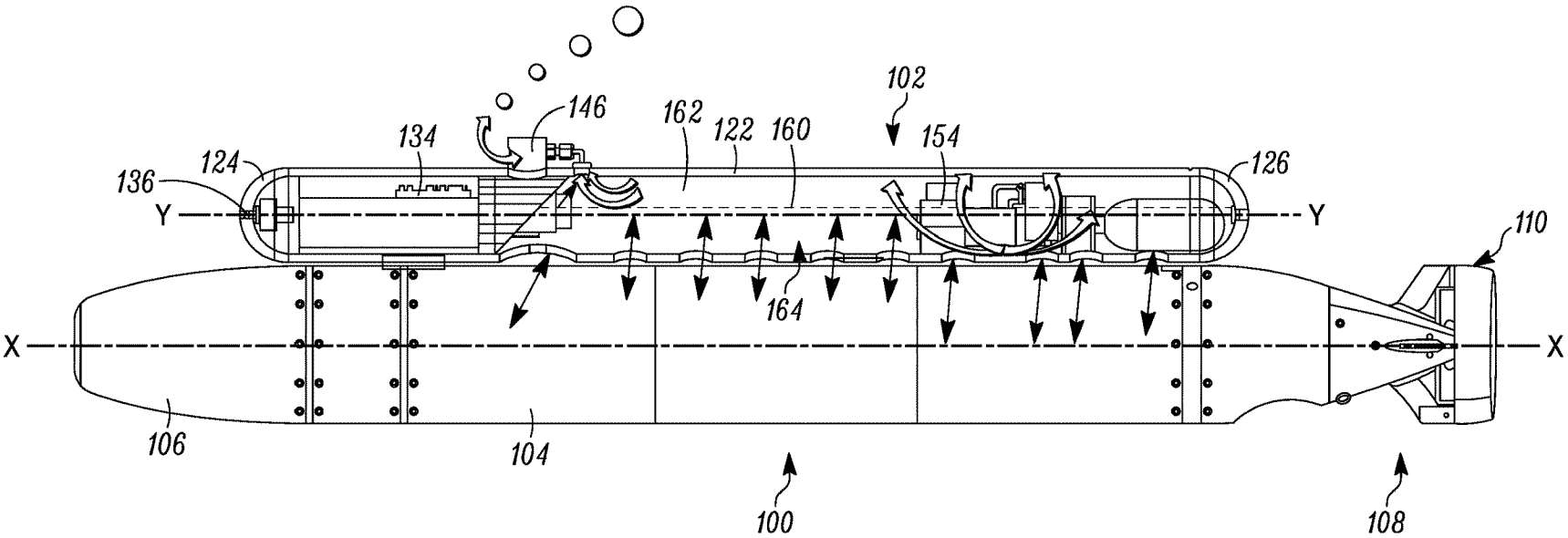
FIG. 6 is a side view of the AUV together with the expendable ballast tank in cross-section showing operation of the expendable ballast tank.

FIGS. 4-6 illustrate another example of an AUV 100 with an external, deployable unmanned payload which in this example is an external, deployable, expendable ballast tank 102. The use of an expendable ballast tank 102 as the payload creates additional mission opportunities. For example, in one embodiment, after launching the AUV 100 with the expendable ballast tank 102, the AUV 100 can remain dormant, with the expendable ballast tank 102 controlling and maintaining a predetermined depth of the AUV 100. The AUV 100 and ballast tank 102 can then loiter and drift for a predetermined period time, such as hours, days, weeks, etc. until the predetermined time period is met. The expendable ballast tank 102 can then be detached from the AUV 100 at which point the AUV 100 becomes active and begins its mission.

As will be discussed further below, the AUV 100 and the ballast tank 102 can be releasably attached together using a suitable releasable mechanism, such as the single wire 46 concept discussed above for FIGS. 1-3. However, as discussed below, in this embodiment the burn wire for initiating release can be located on the ballast tank 102.

With reference to FIG. 4, the AUV 100 is of generally conventional construction known in the art including a cylindrical hull 104, a hydro-dynamically shaped, for example bullet shaped, forward end 106, and an aft end 108 containing a propulsion mechanism 110, such as a propeller 112 (best seen in FIG. 4) driven by a motor 114 (shown in dashed lines in FIG. 4), for propelling the AUV 100 through the water. The AUV 100 can also include a steering mechanism, separate from or integral with the propulsion mechanism 110, for example steerable fins 116 (best seen in FIG. 4) or the propulsion mechanism 110 can be steerable to function as the steering mechanism.

The AUV 100 will also include a suitable power supply 118 (shown in dashed lines in FIG. 4), for example one or more batteries, disposed within the hull 104 for providing power to the AUV 100 and optionally provide power to the ballast tank 102. Suitable control electronics for controlling operation of the AUV 100 can also be disposed within the hull 104.

The AUV 100 can also carry one or more mission specific packages 120 (shown in dashed lines in FIG. 4) suitable for its intended mission. Examples of mission specific packages include, but are not limited to, various sensor packages, sonar packages, munitions packages, communications packages, and the like.

With reference to FIGS. 4-6, the ballast tank 102 is illustrated as being releasably mounted on the AUV 100 in a vertically stacked configuration. However, the ballast tank 102 and the AUV 100 can be arranged in a horizontal side-by-side configuration as well, or in any other configuration where the ballast tank 102 is mounted external to the hull 104 of the AUV 100. Using a vertically stacked arrangement is easier to implement since the disruption to the hydrodynamics of the AUV 100 are easier to compensate for.

As shown in FIG. 6, the AUV 100 includes a first longitudinal axis X-X, and the ballast tank 102 includes a second longitudinal axis Y-Y. In the vertically stacked configuration illustrated in FIG. 6, as well as in a horizontal side-by-side configuration, the axes X-X and Y-Y are parallel to one another but offset from each other.

To be more hydro-dynamically efficient, the ballast tank 102 is illustrated in FIGS. 4-6 as having a cylindrical configuration with a generally cylindrical hull 122 having a hydro-dynamically shaped, such as bullet shaped, forward end 124 and a hydro-dynamically shaped, such as bullet shaped, aft end 126. In the illustrated embodiment, the ballast tank 102 does not have a separate propulsion mechanism or steering capability. Therefore, when the ballast tank 102 is released from the AUV 100, the ballast tank 102 is intended to float submerged under the water, float at or near the surface of the water, and/or sink to the bottom, depending upon the buoyancy characteristics of the ballast tank 102 and its intended mission.

The ballast tank 102 is designed to permit its buoyancy characteristics to be selectively controlled. In particular, referring to FIG. 5, the ballast tank 102 includes a first section 130 that, during use, defines a dry section that is sealed to prevent ingress of water into the first section 130. The first section 130 includes one or more batteries 132 that provide power to various components of the ballast tank 102, control electronics 134 that control operation of the ballast tank 102, and a pressure transducer 136 that senses the pressure of outside water acting on the forward end 124 which is used to determine depth of the ballast tank 102 in the water.

With continued reference to FIG. 5, the ballast tank 102 also includes a generally hollow, second section 140 to the rear of the first section 130. The section 140 is a generally hollow portion of the hull 122. The section 140 can be considered a wet section that allows ingress and egress of water therefrom via a plurality of openings 142 formed in the hull 122. At the upper end of the hull 122, an air exit opening 144 is formed in the section 140, with air flow through the opening 144 to an air outlet 145 being controlled by a solenoid valve assembly 146. A tank 148 containing a supply of high pressure gas, for example air, is removably mounted near the rear of the second section 140. The tank 148 is normally sealed prior to installation to prevent escape of the high pressure gas. A puncher device 150 is provided to break the seal on the tank 148 upon installation of the tank 148. Instead of a seal and a puncher device, a mechanical valve assembly can be provided to release the high pressure gas from the tank 148. Various fluid lines 152 are provided between the tank 148 and a high pressure gas outlet 153 that discharges into the section 140. Flow of the high pressure gas through the outlet 153 is controlled by a solenoid valve assembly 154.

Referring to FIGS. 5 and 6, operation of the ballast tank 102 will now be described. The pressure transducer 136 determines the depth of the ballast tank 102, and thus the depth of the AUV 100. The control electronics 134 control the solenoid valve assemblies 146, 154 to control the buoyancy characteristics of the ballast tank 102, thereby controlling the depth of the AUV 100. In particular, FIG. 6 shows a representative boundary 160 between air 162 contained in the upper part of the interior of the second section 140 of the hull 122 and water 164 contained in the lower part of the interior of the second section 140 of the hull 122. Opening the valve of the valve assembly 146 allows air 162 to vent from the hull 122 through the opening 144 and the outlet 145 as shown by the arrows in FIG. 6, which permits more water 164 to flood into the hull 122 through the openings 142 thereby reducing the buoyancy of the ballast tank 102 and causing the depth of the AUV 100 to increase. To increase buoyancy and decrease the depth of the AUV 100, the valve of the valve assembly 146 is closed, and the valve of the valve assembly 154 is opened to introduce high pressure gas into the hull 122. The high pressure gas forces water 164 out of the openings 142 in the hull 122 as shown by the arrows in FIG. 6, which increases the amount of air 162 in the hull 122 and increases the buoyancy of the ballast tank 102.

The ballast tank 102 is a structure that is separate from the AUV 100, and is not a part or sub-part of the AUV 100. As a result, the displaced volume of the AUV 100 remains the same before and after release of the ballast tank 102 from the AUV 100.

The AUV 100 and the ballast tank 102 are releasably attached in any suitable manner. For example, the AUV 100 and the ballast tank 102 can be releasably attached in a manner similar to the attachment described above for the AUV 10 and the payload 12 shown in FIGS. 1-3.

In particular, referring to FIG. 4, one or more payload supports 170 are fastened to the AUV 100, for example on the exterior surface of the hull 104. In the illustrated example, there are two payload supports 170, one of the supports 170 supporting a forward end of the ballast tank 102, and one of the supports 170 supporting a rear end of the ballast tank 102. The payload supports 170 passively support the ballast tank 102 on the AUV 100 without fastening the ballast tank 102 to the AUV 100 so that, absent other means for retaining the ballast tank 102 to the AUV 100, the ballast tank 102 can freely separate from the payload supports 170. In the illustrated example, each payload support 170 comprises a curved support bracket that generally matches the curvature of the cylindrical hull 104 of the ballast tank 102 so that the ballast tank 102 rests on the curved brackets when the ballast tank 102 is attached to the AUV 100. However, other support configurations can be used.

Referring to FIGS. 4 and 5, a releasable mechanism 172 releasably fastens the ballast tank 102 on the AUV 100. Any releasable mechanism 172 that can retain the ballast tank 102 on the AUV 100, and that can be actuated to release the ballast tank 102 from the AUV 100, can be used.

In the illustrated embodiment, the releasable mechanism 172 comprises a one-piece wire 174, similar to the one-piece wire 46, that crosses over and around the AUV 100 and the ballast tank 102, and attaches at its free ends (not shown), similar to the free ends 48*a*, 48*b*, to a burn wire 176 that is similar to the burn wire 50 seen in FIG. 2. In this example, the burn wire 176 (see FIG. 5) is located in or on the ballast tank 102 instead of in or on the AUV 100 like in the embodiment in FIGS. 1-3.

The one-piece wire 174 is sufficient to retain the ballast tank 102 on the AUV 100 during typical anticipated use. To release the ballast tank 102, electricity is sent through the burn wire 176 which causes the burn wire 176 to heat up and break. When the burn wire 176 breaks, the ends of the wire 174 are released thereby releasing the ballast tank 102 from the AUV 100.

FIG. 4 shows another variation of securing the ballast tank 102 to the AUV 100 where a pair of forward and rear wires 180*a*, 180*b* that are secured by burn wires (not shown) attach the ballast tank 102 from the AUV 100. In this embodiment, one of the wires 180*a*, 180*b*, such as the rear wire 180*b*, can hold a removable seal 182 in place that covers a pressure switch on the AUV 100 that controls activation of the AUV 100. The seal 182 is removed when the wire 180*b* is released upon destruction of the burn wire, thereby activating the AUV 100.

Figure 7A:
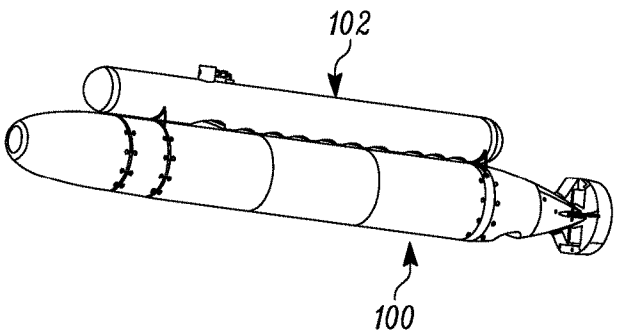

The construction of the ballast tank 102 permits a number of possible mission scenarios to be implemented. For example, one example mission scenario is illustrated in FIGS. 7A-D. FIG. 7A shows the AUV 100 and the ballast tank 102 deployed in the water. During this time, the AUV pressure switch is covered by the removable seal 182 that is held in place by the wire 180*b*. Therefore, the AUV 100 is dormant, with the expendable ballast tank 102 controlling and maintaining a predetermined depth of the AUV 100. The AUV 100 and ballast tank 102 loiter and drift for a predetermined period time, such as hours, days, weeks, etc.

Figure 7B:
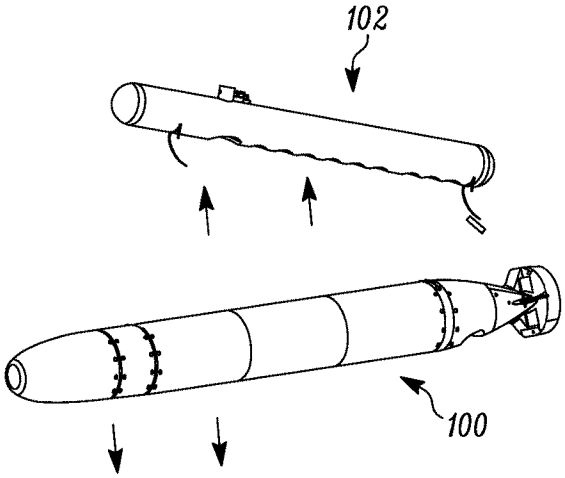

With reference to FIG. 7B, once the predetermined time period is reached, the ballast tank 102 control, which is part of the control electronics 134, causes electrical energy to be directed through the burn wires connected to the wire 180*a*, 180*b*, causing the burn wires to heat up and break, thereby releasing the wires 180*a*, 180*b* and allowing the ballast tank 102 to release from the AUV 100. The detached ballast tank 102 is initially positively buoyant and begins to rise as shown by the arrows in FIG. 7B. In addition, the AUV 100 is initially negatively buoyant and begins to sink as shown by the arrows in FIG. 7B. When the wires 180*a*, 180*b* are released, the seal 182 over the pressure switch of the AUV is removed so that the AUV 100 becomes active.

Figure 7C:
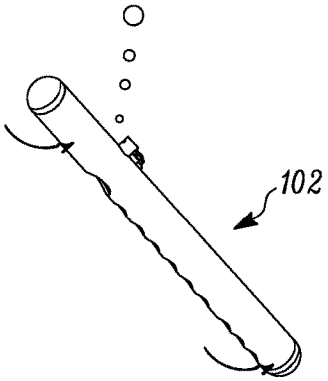

Referring to FIG. 7C, in one embodiment, the ballast tank 102 can be immediately scuttled so that it sinks to the bottom by opening the valve of the valve assembly 146 so that the ballast tank 102 becomes negatively buoyant. In an alternative embodiment, the ballast tank 102 can be initially sent to or near the surface of the water so that a mission specific package 184 (seen in FIG. 4) of the ballast tank 102 can perform a mission. For example, the package 184 can be a communications package allowing the ballast tank 102 to transmit and/or receive communications including, but not limited to, transmit a signal indicating the current global position of the ballast tank 102, or send out jamming signals to jam communications in the area. After the mission of the package 184 is completed, the ballast tank 102 can then be scuttled as discussed above so that it sinks to the bottom.

Figure 7D:
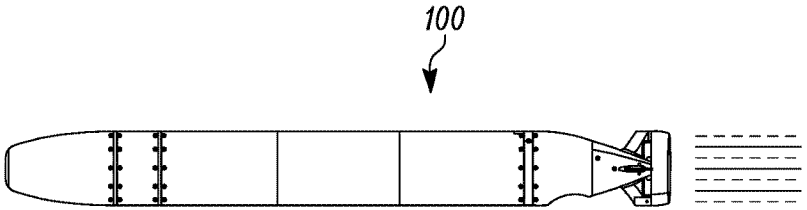

Referring to FIG. 7D, after separation of the ballast tank 102, the AUV 100 becomes active and can begin its mission. The mission can include, but is not limited to, traveling to a new location to create a stand-off distance between the AUV 100 and the ballast tank 102.

The AUV 10 and the payload 12, and the AUV 100 and ballast tank 102, can be launched from any suitable launch platform including, but not limited to, a surface or submerged vessel, air dropped into the water from an airborne vehicle, launched from shore, or launched from any other platform.

FIGS. 8A-C illustrate a launch kit 200 that can be used to launch the AUV 10 and the payload 12, or the AUV 100 and ballast tank 102, from a launch platform such as a submarine. The launch kit 200 includes a pair of shells 202*a*, 202*b* and an end cap 204. The shells 202*a*, 202*b* are releasably connected to one another and generally surround the AUV 10/payload 12 or the AUV 100/ballast tank 102 combination. The end cap 204 closes the front end of the shells 202*a*, 202*b*. After being launched from the launch platform, the shells 202*a*, 202*b* separate and fall away along with the end cap 204, freeing the AUV 10/payload 12 combination or the AUV 100/ballast tank 102 combination for their mission.

The examples disclosed in this application are to be considered in all respects as illustrative and not limitative. The scope of the invention is indicated by the appended claims rather than by the foregoing description; and all changes which come within the meaning and range of equivalency of the claims are intended to be embraced therein.

The invention claimed is:

1. A combination comprising:

an autonomous underwater vehicle having a vehicle hull with an exterior surface, a propulsion mechanism, and a vehicle power supply disposed within the vehicle hull;

an external payload that is releasably supported on the exterior surface of the autonomous underwater vehicle with a longitudinal axis of the autonomous underwater vehicle and a longitudinal axis of the external payload parallel to one another;

the external payload includes a payload hull, and a payload power supply within the payload hull;

at least one payload support between the vehicle hull and the payload hull that passively supports the external payload on the autonomous underwater vehicle without fastening the payload to the autonomous underwater vehicle; and a releaseable mechanism that releasably fastens the external payload to the autonomous underwater vehicle, the releasable mechanism includes a burn wire and a wire that crosses over the autonomous underwater vehicle and the external payload.

2. The combination of claim 1, wherein the at least one payload support comprises a curved support bracket having a curvature that generally matches a curvature of the payload hull.

3. The combination of claim 1, wherein the external payload further includes a mission package within the payload hull, and the mission package comprises one or more of a sensor package, a sonar package, a munitions package, a communications package, and ballast.

4. The combination of claim 1, wherein the external payload does not include a propulsion mechanism.

5. The combination of claim 4, wherein the autonomous underwater vehicle includes a steering mechanism and the external payload does not include a steering mechanism.

6. The combination of claim 1, wherein the external payload is supported on the exterior surface of the vehicle hull in a vertically stacked configuration or a horizontal side-by-side configuration where the longitudinal axis of the autonomous underwater vehicle and the longitudinal axis of the external payload are parallel to and offset from one another.

7. The combination of claim 1, wherein the vehicle hull is cylindrical, and the payload hull is cylindrical.

8. The combination of claim 1, wherein the external payload includes a ballast tank.

9. A method comprising submerging the combination of claim 1 under water, and deploying the external payload from the autonomous underwater vehicle while the combination is submerged under the water.

* * * * *